United States Patent [19]

Mieczkowski

[11] 4,111,357

[45] Sep. 5, 1978

[54] HIGH ENERGY SAVING HEAT EXCHANGER FOR FURNACES

[76] Inventor: Walter L. Mieczkowski, 33611 Curcio, Sterling Heights, Mich. 48077

[21] Appl. No.: 822,553

[22] Filed: Aug. 8, 1977

[51] Int. Cl.[2] ..... F28F 1/10

[52] U.S. Cl. ..... 236/11; 126/110 R; 165/DIG. 2

[58] Field of Search ..... 236/11; 126/85 B, 110 R, 126/110 AA; 165/DIG. 2

[56] References Cited

U.S. PATENT DOCUMENTS

| | | | |
|---|---|---|---|
| 2,022,835 | 12/1935 | Whiteley | 236/11 X |
| 2,189,749 | 2/1940 | Windheim et al. | 165/DIG. 2 |
| 2,504,315 | 4/1950 | Feuerfile | 126/110 R |

*Primary Examiner*—Dorsey Newton

*Attorney, Agent, or Firm*—Cullen, Settle, Sloman & Cantor

[57] ABSTRACT

A high energy saving heat exchanger is provided for the hot exhaust gases of a furnace which has a combustion chamber, a burner with electrical controls, a furnace heat exchanger and an exhaust pipe adapted for connection with a stack. The high energy saving heat exchanger includes a housing having an air chamber with an exhaust inlet connected to said furnace exhaust pipe and an exhaust outlet. An exhaust conduit interconnects said housing exhaust outlet and stack. A continuous circuitous tubing is nested within the air chamber of said housing at one end connected to said exhaust inlet and at its other end connected to said exhaust outlet. An exhaust fan is interposed in said exhaust conduit for drawing exhaust gases through said heat exchanger tubing and delivering said gases under pressure to said stack. A hot air duct is interposed between said housing and a floor surface defining an area to be heated and including a hot air register. Heat duct communicates with said air chamber. A motor operated blower is mounted on said housing and has room air intake communicating with said air chamber for forcing room air through said housing and into contact with said circuituitous exhaust tubing and for delivering through said hot air duct. An outside fresh air conduit has an air intake extending through the building outside wall and an outlet which extends into the combustion chamber. A normally closed motor operated damper is disposed within said fresh air conduit whereby upon energization of said burner said damper is opened, said air blower activated and said exhaust fan energized.

11 Claims, 5 Drawing Figures

HIGH ENERGY SAVING HEAT EXCHANGER FOR FURNACES

BACKGROUND OF THE INVENTION

Heretofore efforts have been made to utilize by a heat exchanger some of the heat remaining in the exhaust gases after it leaves the furnace and before entering the exhaust stack. Examples of such heat exchanger are shown in the following U.S. Pat. Nos.:

2,468,909
3,120,225
3,944,136
350,452
2,276,400
2,362,940
3,884,292

Each of the aforementioned Patents are directed to involved complicated structures which in one way or another seek to utilize some of the exhaust heat of a furnace before it enters the stack. The above examples of efforts to utilize exhaust heat have been inefficient and include one or more of the following elements; namely, a heat exchanger to receive exhaust gases from the furnace before entering the stack; devices for transferring fresh air through the heat exchanger to utilize some of this exhaust heat, and in some cases, a source of outside fresh air for direction into the combustion chamber.

SUMMARY OF THE INVENTION

It is an object of the present invention to provide an improved and highly efficient high-energy saving heat exchanger for a furnace having a burner with electrical controls and a heat exchanger and a hot air exhaust and wherein, substantially all of the heat of exhaust which would, otherwise, pass up the chimney stack is recovered.

It is a further object to provide an improved high-energy saving heat exchanger which includes circuitous tubing within the heat exchanger housing through which exhaust gases from the furnace pass together with a power-operated fan mounted at the stack for drawing said exhaust gases through the heat exchanger and delivering same under pressure to the stack.

Another object is to incorporate into said high-energy saving heat exchanger an air chamber within which said circuitous tubing is disposed communicating with a hot air duct for delivering heated air through a register into an area to be heated and incorporating a motor-operated blower having a fresh air intake for delivering room air through said heat exchanger and to said register.

It is another object to incorporate a fresh air conduit which communicates with the outside atmosphere for delivering fresh air to the combustion chamber and which includes a normally-closed damper which is power opened upon energization of the furnace to, thus, provide a controlled management of fresh air which is introduced into the combustion chamber sufficient to create the best possible heat from the fuel being used and at the same time, prevent the utilization of already heated air within the building structure for use in supporting combustion.

These and other objects will be seen from the following specification and Claims in conjunction with the appended drawings.

THE DRAWINGS

It will be understood that the above drawings illustrate merely a preferred embodiment of the invention, and that other embodiments are contemplated within the scope of the claims hereafter set forth.

DETAILED DESCRIPTION OF THE INVENTION

Figure 1:
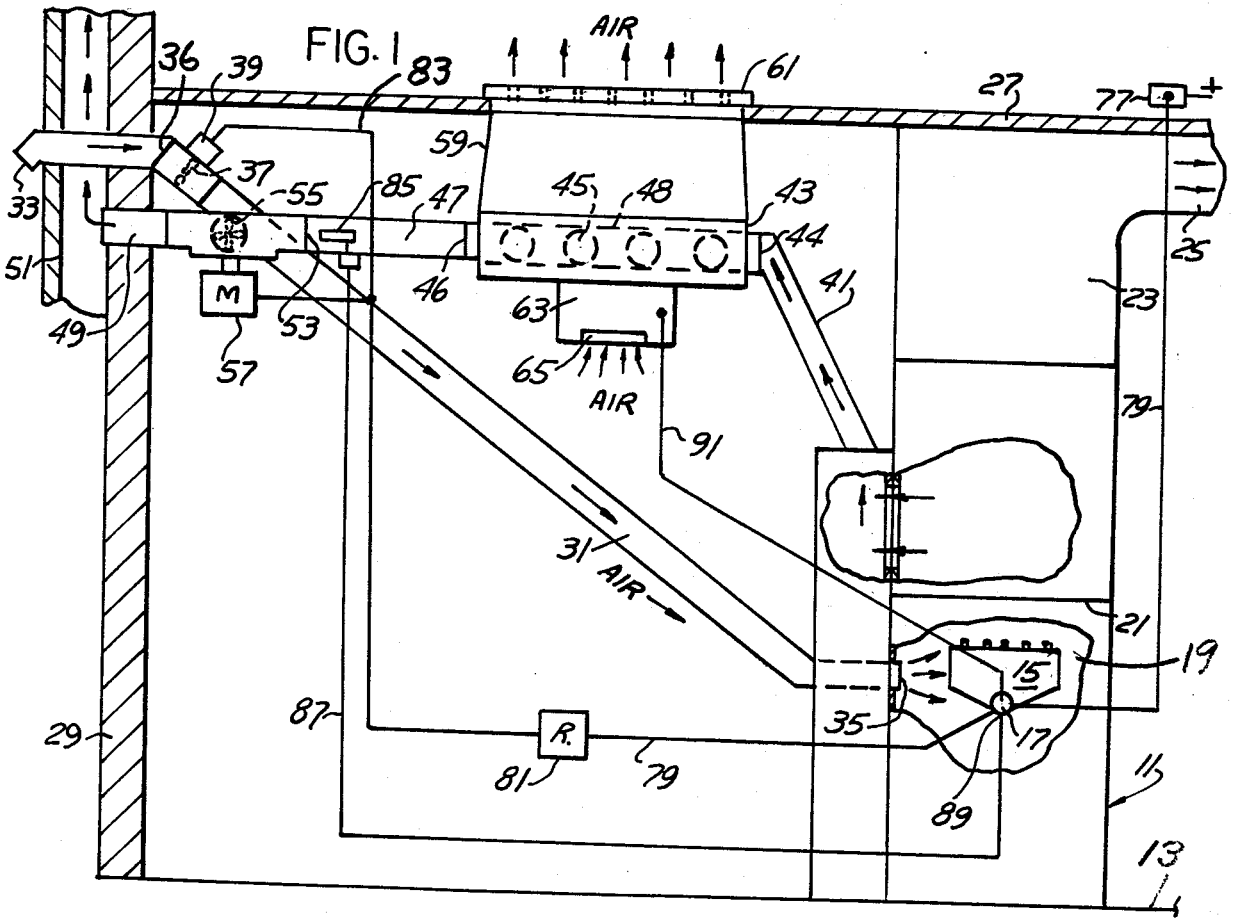
FIG. 1 is a schematic side elevational view of the present high-energy saving heat exchanger in conjunction with the furnace and interposed between the furnace exhaust pipe and the exhaust stack of a building.
Figure 2:
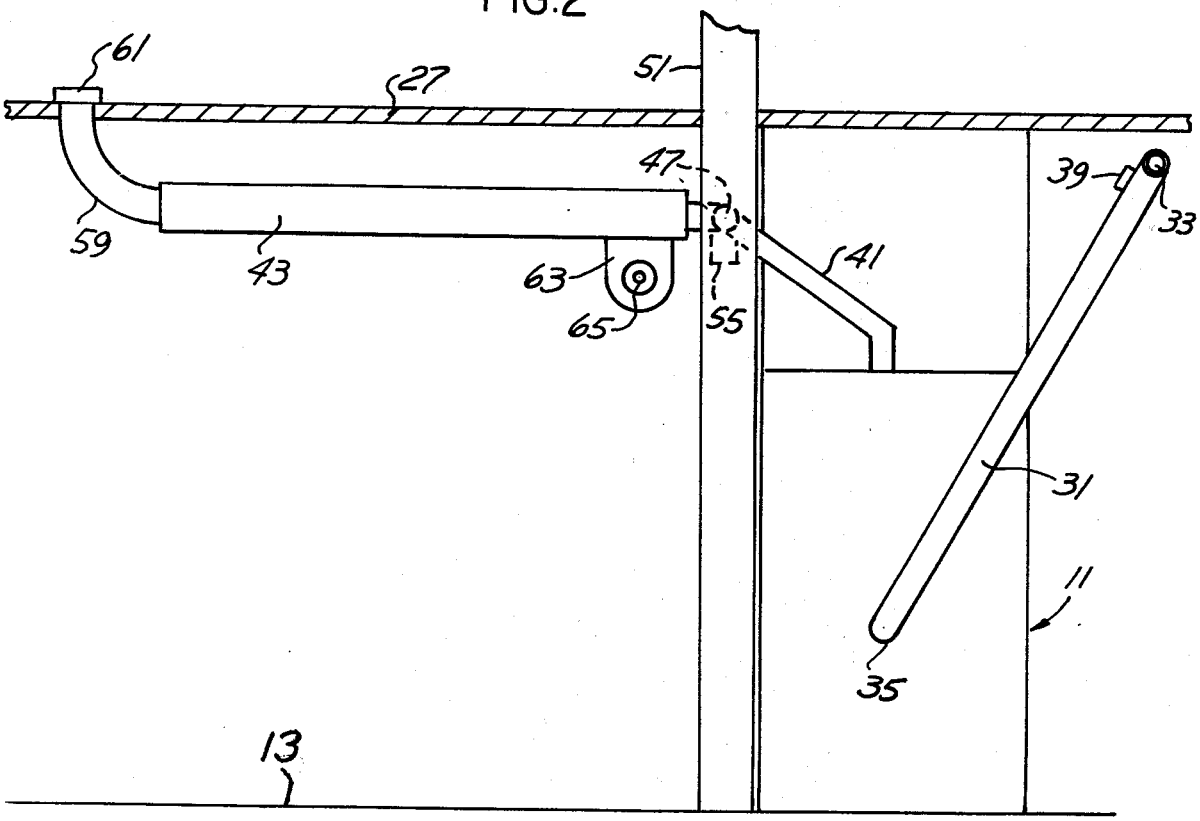
FIG. 2 is a left side elevational view thereof.

Referring to the drawings, FIGS. 1 through 5, a hot air furnace is indicated at 11 in FIGS. 1 and 2 resting upon a floor surface 13 and having a conventional burner 15 and controls 17, within combustion chamber 19 and in communication with a conventional heat exchanger 21 schematically shown.

The conventional heat exchanger terminates in the plenum 23 in turn communicating with hot air ducts 25 adjacent the floor 27 movable therethrough in a conventional manner by a suitable blower not shown.

The furnace is arranged adjacent the outside building wall 29, fragmentarily shown, and adjacent stack 51.

The fresh air intake pipe 31 has an air inlet 33 which extends through the outside wall 29 and has an outlet 35 which terminates upon the interior of combustion chamber 19. The damper section 36 is interposed into the fresh air intake pipe and includes the normally closed damper 37 and a suitable solenoid 39 or other motor means for causing opening of the damper when energized.

Hot exhaust pipe 41 extends from the conventional heat exchanger 21 within said furnace, contains gases at a temperature of 500° F., approximately, and is normally adapted for connection with the stack 51 adjacent the outside building wall 29.

HIGH ENERGY SAVING HEAT EXCHANGER

Figure 3:
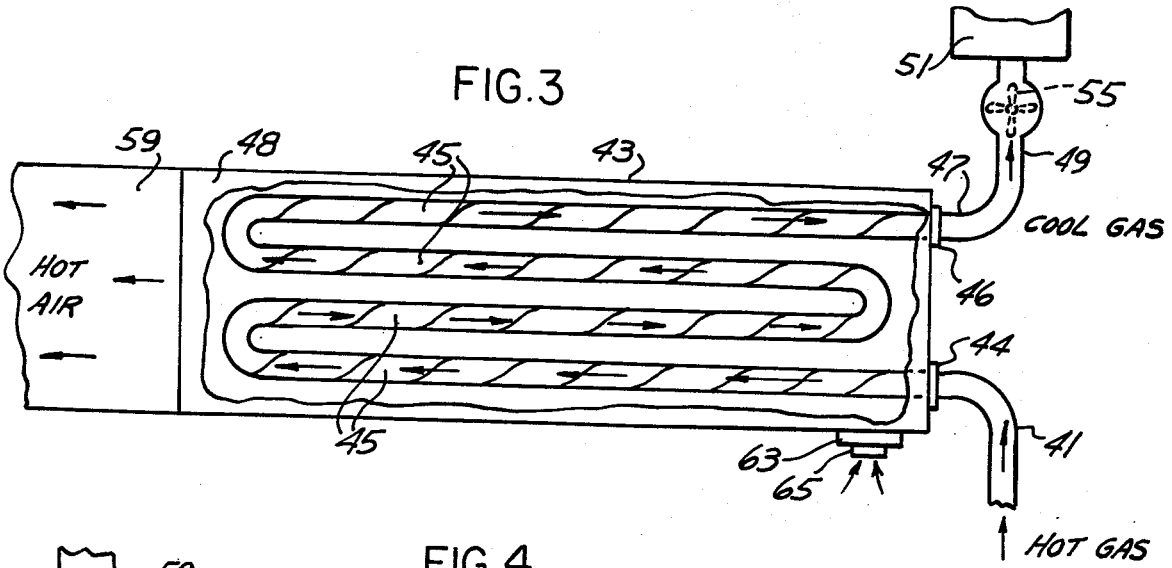
FIG. 3 is a fragmentary plan view of the high-energy saving heat exchanger and a portion of the hot air duct.
Figure 4:
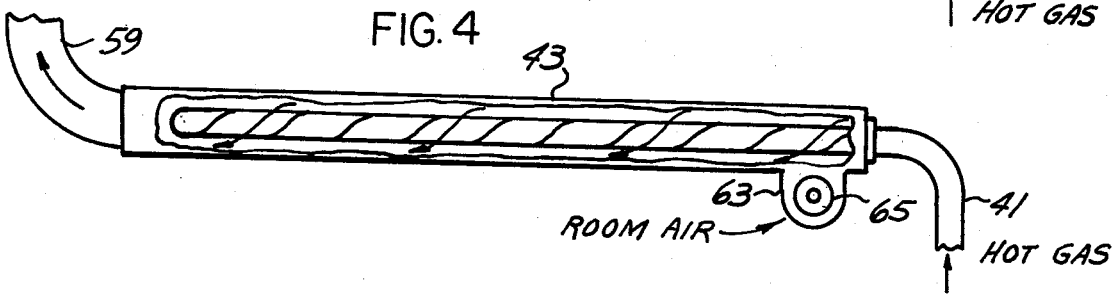
FIG. 4 is a side elevational view thereof.

Incorporated into the hot exhaust pipe 41 interposed between the furnace and the stack is the present high energy saving heat exchanger having a hollow housing 43 shown fragmentarily and schematically in plan in FIG. 3 with the side view thereof being shown in FIGS. 2 and 4.

In the illustrative embodiment and merely for illustration, this housing has a dimension of 6" × 24" × 96". This is, of course, an illustrative embodiment since the size of the heat exchanger can be modified as desired to meet specific conditions. Said housing has an exhaust gas intake 44 and an exhaust gas outlet 46, FIG. 1.

Within the air chamber 48, FIG. 3 of said heat exchanger housing, there is disposed a circuitous metal tubing 45, tubing which in the illustrative embodiment is three to six inches in diameter and is of a length of forty feet approximately, for illustration only.

The exhaust inlet 44 is connected to one end of said circuitous tubing to which is also joined a hot air exhaust pipe 41.

The opposite or outlet end of the said tubing is connected to the exhaust outlet 46 which, in turn, is connected by the exhaust conduit 47 to the stack 51 as at exhaust outlet 49.

A cylindrical fan section 53 is interposed between the ends of the exhaust conduit 47 and includes an exhaust fan 55 operated by motor 57 connected into the electrical circuit 79 hereafter described.

The heat exchanger housing 43 is arranged so as to be above the furnace 11 and is below and adjacent the floor 27 of the building. Hot air duct 59 interconnects the air chamber 48 within the housing 43 and a suitable hot air register 61 is mounted upon the floor 27 as best shown in FIG. 1.

In FIG. 3, it is shown that the hot air duct is arranged adjacent one end of housing 43. Adjacent the other end of said housing is a blower 63 having a room air inlet 65 which communicates with the air chamber 48 upon the interior of the housing 43.

Figure 5:
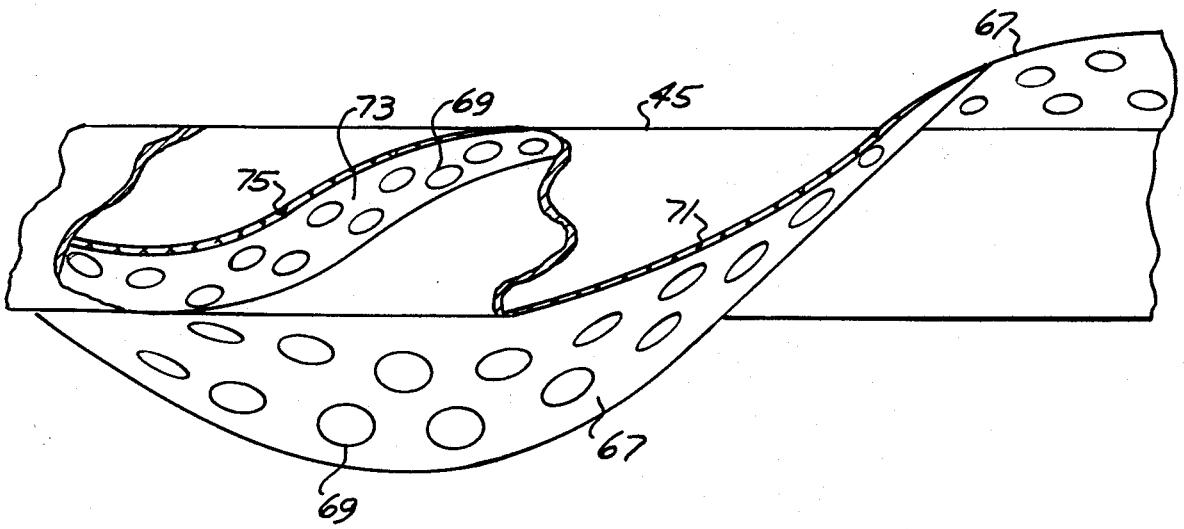
FIG. 5 is an enlarged perspective view of a section of the circuitous tubing within the heat exchanger showing perforated interior and exterior fins along the length thereof.

FIG. 5 shows on an enlarged scale a section of the circuitous tubing 45 within housing 43 which has throughout its length upon the exterior thereof the continuous spiral fin 67 apertured throughout at 69 suitably secured to the exterior of the said tubing as by the welds or rivets at 71, or any other manner.

As also shown by the broken away portion of said tubing in FIG. 5, there is provided upon the interior of said tubing a continuous spiral-shaped continuous fin 73 which extends throughout the interior length of said tubing and is likewise apertured throughout at 69 and is suitably secured upon the interior of said tubing as by the welds or rivets at 75.

This provides a means for increasing the efficiency of the heat exchanger by providing heat exchange increased area fins 67 upon the exterior of the tubing for registry with ambient air delivered under pressure through said housing into the hot air duct 59 and register 61. The apertures 69 provides a means for cutting down any impediment to the flow of air therethrough. Likewise, the internal fins 73 provide a means of absorbing additional heat from the exhaust gases passing through tubing 45 before exiting into the conduit 47 at a temperature of approximately 80° F.

An electrical circuit for the operative mechanisms herein is schematically shown at 79 in FIG. 1 and includes thermostat 77 within a room area to be heated and with the power source schematically shown. The electrical circuit is connected to the furnace controls schematically shown at 17 and to the relay switch 81 which, in turn, is connected to the motor 57 for the exhaust fan. Said circuit includes a lead 83 which is connected to the solenoid 39 or other motor means for opening the normally closed damper 37.

As a safety mechanism there is provided upon the interior of the exit end of heat exchanger conduit 47 a sail switch 85 connected by circuit lead 87 to the node 89 in the primary circuit 79, FIG. 1. This is a normally open limit switch. When there is movement of exhaust gases due to proper functioning of fan 55, the switch is actuated closing the circuit to the burner control 17. This control is connected by lead 91 directly to air blower 63, energizing same. Thus, the blower goes on as soon as the furnace is activated.

In the event the fan 55 fails to operate, sail switch 85 opens, breaking the power source to the furnace control 17, shutting down the burner 15.

OPERATION

The invention was scientifically formulated for safety and efficiency for a hot air furnace, thereby conserving energy.

The components used are not new in the art, but the combination in their use is novel, safe and 99% efficient with almost no heat loss.

The controlled measurement of fresh air introduced into the combustion chamber is sufficient to create the best possible heat from the fuel being used. This is an important feature.

Although the air in this system is free flowing, very little energy is used to circulate it. Fresh cold air enters through a tube 31 from outside, at time of ignition, through a damper 37 that is normally closed, which opens electrically with solenoid 39 with the exhaust fan 55 and blower fan 63 in the exchanger 43. This air immediately turns into hot exhaust gases, begins to rise to exit, goes through the furnace heat exchanger 21 still as hot as 500° F. and exits from the furnace. These heated gases in pipe 41 are then drawn into the heat exchanger 43, which is at a higher level than the furnace. The gases are drawn through, which is another feature of note.

The heat exchanger consists of approximately 40 feet of circuitous tube 45 with spiral like fins 73–67 inside and outside, to extract most of the heat in the tube, without restricting the free flow of the gases inside and the heated air outside the tube. The temperature of the gases upon exit at the stack is less than 80° F., which is near the temperature in the room. This is why 99% efficiency is claimed.

The exhaust fan 55, which is mounted at the stack, is one of the most important components, as it controls all of the fresh air and circulates the hot gases through the system, which includes two heat exchangers, then finally into the stack 51 as cool gases.

A 4 inch diameter tubing 45 is used in continuous circuitous passage approximately 40 feet long, with spiraling, perforated metal fins 67–73 throughout its length. This tube is inside metal enclosure, 6" × 24" × 96". On the bottom on one end, the blower fan 63 is mounted in an opening to blow warm room air through an opening on the other end, which is ducted at 59 into the area to be heated.

The exhaust fan 55, another feature of note, is a safety feature because it works as a vacuum mounted at the chimney. It draws out all unwanted gases. Even if some of the tube would tend to leak, none of the poisonous gases would escape into the living quarters. Every cubic foot of exhaust gas is expelled.

By using the outside air for combustion, the already heated air in the building is conserved by equalizing the inside and outside air. Therefore, outside cold air will not be drawn in as in most homes where the combustion air is forced up the chimney stack, creating a low pressure inside causing cold air to seep in to replace it.

Exhaust gases restricted in any way, or being forced into a connecting system, could be hazardous. This would have a tendancy to leak and would be dangerous.

A sail switch 85, FIG. 1, shuts the valve 17 that controls the fire in the fire chamber 19 if, for any reason, the exhaust fan 55 fails to work.

A 50% saving in fuel is not claimed but recovery of most heat that would otherwise escape up the chimney stack is claimed.

Having described my invention, reference should now be had to the following Claims:

I Claim:

1. In a furnace for a building having a floor and an outside wall, said furnace having a combustion chamber, a burner with electric controls, a furnace heat exchanger and a hot exhaust pipe adapted for connection with a stack;

a high energy saving heat exchanger comprising a housing having an air chamber, an exhaust inlet connected to said furnace exhaust pipe and an exhaust outlet;

an exhaust conduit interconnecting said exhaust outlet and stack;

a continuous circuitous exhaust tubing nested within the air chamber of said housing, at one end connected to said exhaust inlet and at its other end connected to said exhaust outlet;

an exhaust fan section in said exhaust conduit mounted adjacent to said stack;

a motor operated exhaust fan in said fan section for drawing exhaust gases through said heat exchanger tubing and delivering said exhaust gases under pressure through said conduit into said stack;

a hot air duct interposed between said housing and said floor defining an area to the heated, and including a hot air register;

said hot air duct communicating with said air chamber;

a motor operated blower on said housing having a room air intake communicating with said air chamber, for forcing room air through said housing to said register;

and an outside fresh air conduit having an air intake extending through said outside wall and an outlet extending into said combustion chamber;

a damper section interposed in said fresh air pipe;

a normally closed damper in said damper section;

and a motor on said damper section connected to said damper, adapted for opening said damper when energized.

2. In the high energy saving heat exchanger of claim 1, an electrical conduit including a power source and a room thermostat; said circuit interconnecting said thermostat and burner controls, blower motor, exhaust fan motor and damper motor, whereby when said thermostat calls for heat, the circuit is closed to simultaneously energize said burner, said air blower, exhaust fan and damper motor.

3. In the high energy saving heat exchanger of claim 2, a normally closed micro-sail switch in said conduit upstream of said exhaust fan section and connected with said circuit to deactivate said burner on failure of said exhaust fan.

4. In the high energy saving heat exchanger of claim 1, said exhaust tubing being of such length and diameter as to provide maximum heat exchange areas within said air chamber whereby the temperature of said exhaust gases being about 500° F. approximately and the temperature of said exhaust gases in said exhaust conduit being about 80° F. approximately.

5. In the furnace of claim 1, said energy saving heat exchanger being above said furnace.

6. In the high energy heat saving heat exchanger of claim 1, the air inlet of said blower being adjacent one end of said housing; and said hot air duct being connected to the opposite end of said housing whereby room air to be heated passes over all surfaces of said circuitous tubing.

7. In the high energy saving heat exchanger of claim 1, said circuitous tubing being three to six inches in diameter approximately and forty feet in length approximately.

8. In the high energy saving heat exchanger of claim 1, a spiral shaped fin mounted on and extending over the exterior of said tubing throughout its length.

9. In the heat exchanger of claim 8, said fin having a plurality of apertures throughout its length.

10. In the high energy saving heat exchanger of claim 9 and a spiral shaped fin mounted on the interior of said circuitous tubing throughout its length, there being a plurality of apertures formed through said latter fin.

11. In the high energy saving heat exchanger of claim 1, a spiral shaped fin mounted on the interior of said circuitous tubing throughout its length, there being a plurality of apertures formed through said fin.

* * * * *